United States Patent [19]

Prada

[11] 4,332,142

[45] Jun. 1, 1982

[54] HOUSEHOLD REFRIGERATOR INCLUDING ANTI-SWEAT HEATER CONTROL CIRCUIT

[75] Inventor: Luis E. Prada, Louisville, Ky.

[73] Assignee: General Electric Company, Louisville, Ky.

[21] Appl. No.: 196,802

[22] Filed: Oct. 14, 1980

[51] Int. Cl.[3] ..... F25D 21/06

[52] U.S. Cl. ..... 62/152; 62/275

[58] Field of Search ..... 62/248, 80, 152, 275, 62/265

[56] References Cited

U.S. PATENT DOCUMENTS

| | | | |
|---|---|---|---|
| 2,135,091 | 11/1938 | Newill | 62/275 X |
| 2,731,804 | 1/1956 | Grubbs, Sr. | 62/156 |
| 2,896,125 | 7/1959 | Morton | 315/272 |
| 3,443,395 | 5/1969 | Schweiger | 63/140 |
| 3,495,416 | 2/1970 | Morrissey, Jr. et al. | 62/275 X |
| 3,939,666 | 2/1976 | Bashark | 62/150 |
| 4,065,659 | 12/1977 | Yount et al. | 219/398 |
| 4,127,765 | 11/1978 | Heaney | 62/248 X |

*Primary Examiner*—William E. Wayner

*Attorney, Agent, or Firm*—Frederick P. Weidner; Radford M. Reams

[57] ABSTRACT

A refrigerator including a cabinet having storage compartment, an electrical anti-sweat heating means for arming a portion of the cabinet, refrigerating means including a compressor and an evaporator for cooling the compartment, and temperature sensing means to energize the compressor at one predetermined temperature and de-energize the compressor at a second lower temperature. There is provided a switch associated with the temperature sensing means to apply full electrical power to the electrical anti-sweat heating means when the compressor is energized and apply half electrical power to the electrical anti-sweat heating means when the compressor is not energized.

7 Claims, 3 Drawing Figures

HOUSEHOLD REFRIGERATOR INCLUDING ANTI-SWEAT HEATER CONTROL CIRCUIT

BACKGROUND OF THE INVENTION

Household refrigerators generally comprise an outer metal case and at least one inner liner insulated from the case and defining a refrigerated food storage compartment. Due to leakage through the insulating means separating the outer metal case from the liner or due to refrigerated air leakage past the door sealing means, portions of the outer metal case adjacent the access opening to the storage compartment tend to fall below the dew point of the surrounding atmosphere causing the accumulation of moisture in these areas. To prevent such condensation, suitable heating means such as an electric resistance heater, generally known as anti-sweat heater, have been provided to maintain the temperature of the case area adjacent the access openings sufficiently warm so that such condensation does not readily occur. The heating means generally employed has been a low wattage electrical resistance heater connected directly across the power supply lines so as to be continuously energized regardless of whether the refrigerating means for cooling the storage compartment is operating or not. This kind of arrangement, however, can use electrical energy unnecessarily.

Various alternative arrangements to reduce the electric power consumption of the anti-sweat heaters have been used in the past. For instance, U.S. Pat. No. 3,939,666 discloses an electrical control circuit that, when the refrigeration system is not in defrost and there is a high humidity condition, the mullion heater utilizes full power and the stile heater utilizes half electrical power. In the case of low humidity and, again, the refrigerating system is not in defrost, the mullion heater utilizes half electrical power and the stile heater uses no electrical power. When the refrigerating system is in a defrost condition, both the mullion and stile heaters are "off". This arrangement, however, controls power to the heaters by means of a humidity sensor. It does not control the electrical power to the anti-sweat heaters responsive to the compressor operation which is an important aspect of the present invention. When the compressor of the refrigeration system is "on", there is inherently produced more cold air leakage from the refrigerated compartment than when it is "off". However, there is still some reduced amount of cold air leakage that will produce condensation when the compressor is "off".

U.S. Pat. No. 2,135,091 discloses energization of the anti-sweat heaters at full electrical power either only when the compressor of the refrigerating system is operating or all the time when the system is operating.

There is also a prior art arrangement that utilizes a manually operated switch for half electrical power, full electrical power, or no electrical power for the anti-sweat heaters which selection must be made by the user of the refrigerator.

It is desirable in a household refrigerstor, to have the anti-sweat heaters automatically controlled during operation of the refrigeration system so that when the compressor is "on", full electrical power will be supplied to the anti-sweat heaters and when the compressor is "off", only half electrical power will be supplied to the anti-sweat heaters. By my invention, there is provided a refrigerator, including anti-sweat heaters, having a control circuit which will accomplish these desirable results.

SUMMARY OF THE INVENTION

According to one aspect of my invention, there is provided a refrigerator comprising a cabinet including a storage compartment and electrical anti-sweat heater means for warming a portion of the cabinet, refrigerating means including a compressor and an evaporator for cooling the compartment, and temperature sensing means to energize the compressor at one predetermined temperature and de-energize the compressor at a second lower temperature. There is also provided automatic switch means associated with the temperature sensing means to apply full electrical power to the electrical anti-sweat heating means when the compressor is energized and apply half electrical power to the electrical anti-sweat heating means when the compressor is not energized.

DESCRIPTION OF THE PREFERRED EMBODIMENT

Figure 1:
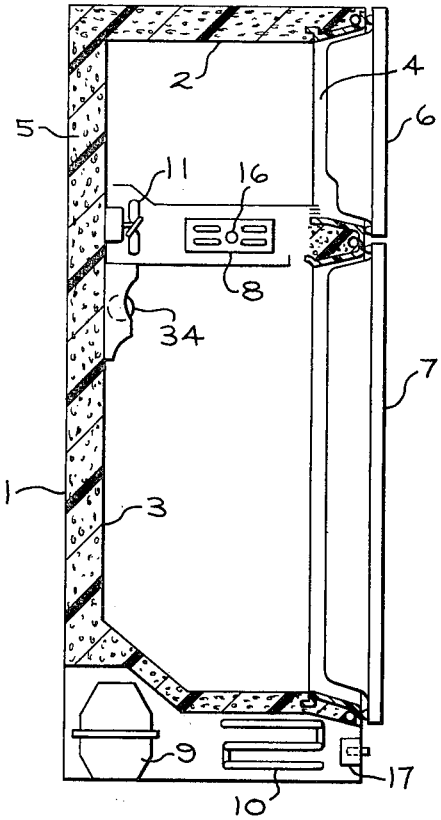
FIG. 1 is a side-elevational cross-sectional view of a household refrigerator including one embodiment of the anti-sweat heater control circuit of the present invention.

With reference to FIG. 1 of the drawing, there is illustrated a refrigerator cabinet including an outer case 1, an upper inner liner 2 defining a freezer storage compartment, and a lower inner liner 3 defining a fresh food storage compartment. The forward edges of both liners are spaced from the forward edges of the case and these spaces are bridged by heat insulating breaker strips 4 while the spaces between the liners and the outer case are filled with suitable insulating material 5. The access openings to the freezer and fresh food compartments are respectively closed by gasketed doors 6 and 7.

Refrigeration for the two compartments is provided by an evaporator 8 positioned in the partition between the two compartments which forms part of the refrigeration system including an electric motor driven compressor 9 and a condenser 10. A fan 11 rearwardly from evaporator 8 provides means for circulating air from the two compartments over the evaporator 8 and back into the compartments.

A thermostatic control means generally indicated by the numeral 34 including a temperature sensing means or thermostat 48, is provided for automatically controlling the operation of the compressor 9 to maintain the temperature within the fresh food compartment within a controlled range. Also, in accordance with the usual practice, this thermostatic control means can be manually adjusted for the desired temperature in the fresh food compartment and also it can be moved to an "off" position whereby the compressor 9 is de-energized regardless of the temperatures within the cabinet.

Evaporator 8 operates at temperatures below freezing and for the purpose of periodically removing accumulated frost from the evaporator surfaces, there is provided a defrost heater 16 which is periodically energized by operation of a timer 17.

Figure 2:
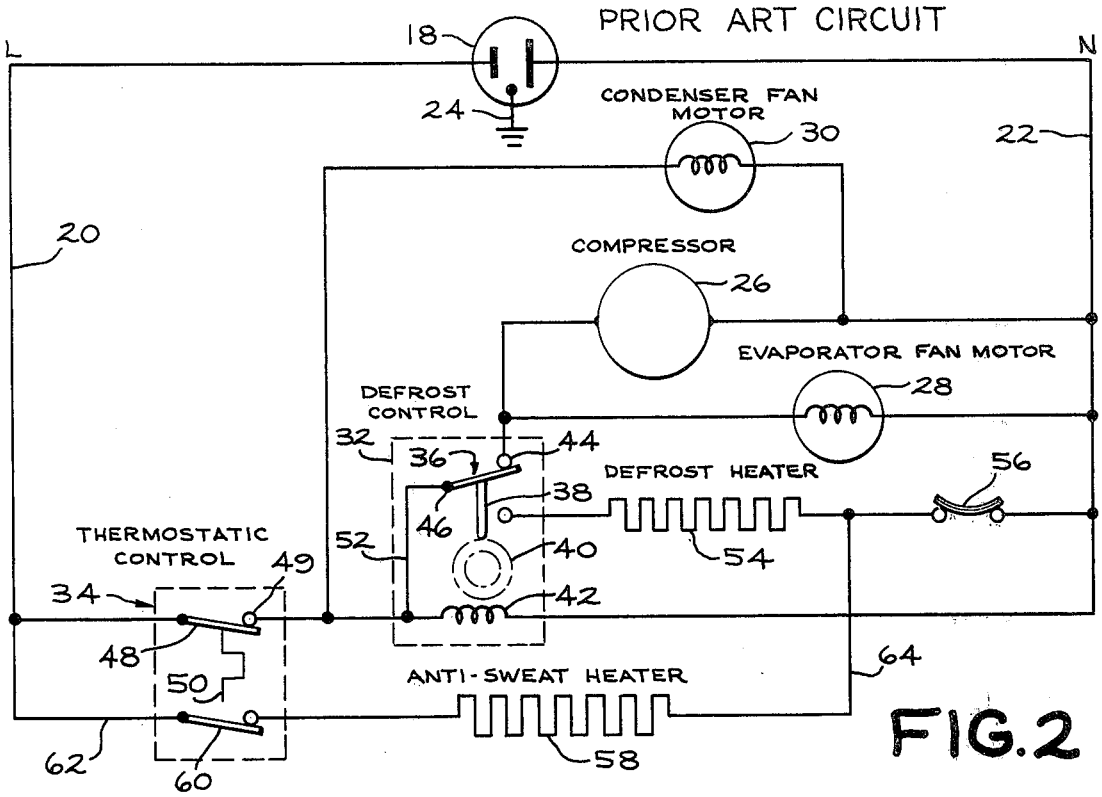
FIG. 2 is an electrical circuit diagram of a refrigerator control system according to the prior art.

The control circuitry and components for controlling the normal and defrost operation of a prior art refrigerator is illustrated in FIG. 2 of the drawing. A conventional power plug 18 supplies L and N supply conductors 20 and 22, and has a connection 24 to ground the frame of the refrigerator. The refrigeration system includes a compressor motor 26 and an evaporator fan motor 28 connected in parallel. The refrigeration system further includes a condenser fan and motor 30 for forced-air cooling of the condenser 10.

For controlled operation of the refrigeration system, the compressor and evaporator fan motors 26 and 28 are connected to the L supply conductor 20 through a defrost control 32 and through the thermostatic control means 34 for controlling the interior temperature of the refrigerator. The compressor, evaporator fan and condenser fan motors 26, 28, and 30 each have return electrical connections to the N supply conductor 22.

The defrost control 32 includes a cam-operated, single-pole double-throw switch 36 operated through a link 38 by a defrost control cam 40 driven by a timing motor 42. When the defrost control switch 36 and the cam 40 are in the cooling position shown, the compressor and evaporator fan motors 26 and 28 are connected through the switch terminals 44 and 46 and through the thermostatic control means 34 to the L supply conductor 20.

The particular thermostatic control means 34 includes a temperature sensing means or thermostat 48 which is a conventional hydraulic type normally employed in refrigerators, and includes a remote temperature-sensing bulb, represented by an element 50, at the end of a small-diameter tube. The thermostat 48 has a range of adjustment for the normal fresh food compartment temperature which setting is normally between 33° F. to 43° F., with 38° F. being a nominal setting. It will be understood that the temperature sensing means 48 operates independently of the defrost control timer 32.

In the operation of the prior art circuitry shown in FIG. 2, thus far described, the thermostat 48 is enabled to cycle the compressor motor 26, the evaporator fan motor 28 and the condenser fan motor 30 as required to maintain the temperature in the refrigerated compartments. Each time the enabled thermostat 48 closes, power is supplied through contact 49 along a conductor 52 to the defrost control timing motor 42 to rotate the defrost control cam 40. In order to initiate automatic defrosting operations, the timing of motor speed and cam arrangement are such that after every $5\frac{1}{2}$ hours of timing motor running time, the cam 40 switches the defrost control switch 36 to the lower position, de-energizing the compressor and evaporator fan motors 26 and 28, and energizing a defrost heater 54. The defrost control switch 36 remains in the lower position for a period of approximately 30 minutes. The N return for the defrost heater 54 is connected through a defrost-terminating bimetallic switch 56 which is adjusted to open at approximately 50° F. Under normal frost loading conditions, the evaporator is completely defrosted and the bimetallic switch 56 opens within the 30-minute defrost duration period determined by the defrost control cam 40 and the defrost control timing motor 42.

While the particular defrost control 32 illustrated is an electro-mechanical device, it will be apparent that various other timing means may be employed. For example, an electronic timer may be used, using either RC or digital counter timing elements. Depending upon the precise timer employed, a different means for interrupting the timer may be appropriate, and not necessarily a simply interruption of power.

The refrigerator control circuit further includes a conventional anti-sweat heater 58, which serves to prevent condensation forming on the visable outer portions of the refrigerator cabinet. The anti-sweat heater is energized through a manually operated power saver switch 60 and a conductor 62 when the switch is in its closed position as shown in the drawing. The anti-sweat heater 58 is de-energized when the power saver switch 60 is manually opened. N return conductor 64 for the anti-sweat heater 58 is connected through the defrost terminating switch 56 to the N power source conductor 22 to prevent the heater 58 from operating during those periods when the evaporator temperature exceeds 50° F. during defrost operations.

Figure 3:
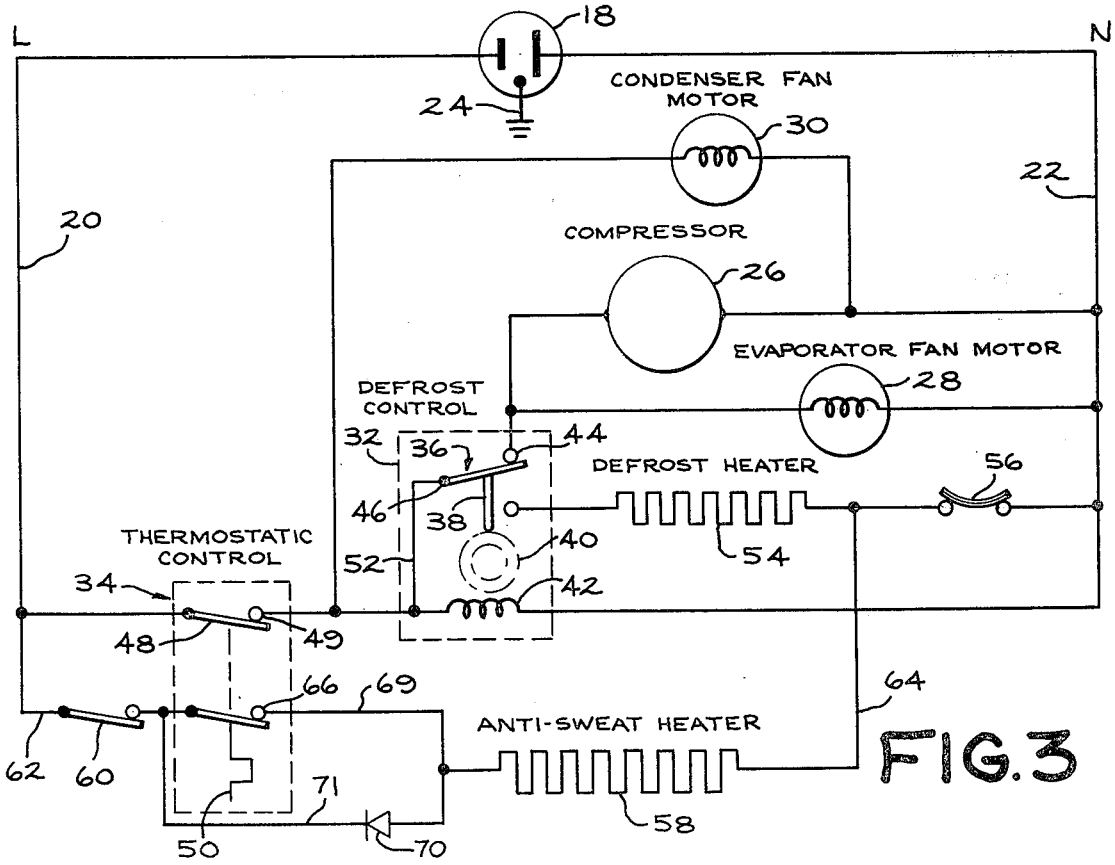
FIG. 3 is an electrical circuit diagram of a refrigerator control system according to one embodiment of the present invention.

Referring now to FIG. 3, there is shown a schematic diagram of a refrigerator control circuit according to the preferred embodiment of the invention. The circuit of FIG. 3 differs from the circuit of FIG. 2 as will be discussed below. It will be appreciated that the circuit of FIG. 3 remains unchanged in other respects and a complete description thereof is not repeated.

The modification to the prior art control circuit shown in FIG. 2 involves the thermostatic control means 34 which has added thereto a second contact 66 plus a rectifier or diode 70 located in the circuit between contact 66 and the anti-sweat heater 58. The conventional manually operated power saver switch 60 may or may not be in the circuit for the purposes of this invention. However, in the preferred embodiment, a power saver switch 60 is shown in both the prior art circuit and in the preferred embodiment circuit of FIG. 3. When the power saver switch 60 is open, there is no power applied to the anti-sweat heater 58. Assuming, however, that the power saver switch 60 is closed and the thermostat 48 is closed, the compressor and the evaporator and condenser fans will be energized. Full electrical power will be supplied from L conductor 20 through contact 66, conductor 69 to the anti-sweat heater 58 then through return conductor 64, bimetallic switch 56 to the N conductor 22. The full electrical power is desirable at this time in the refrigeration cycle as sweating is more prone to occur on the cabinet surfaces which are to be protected by the anti-sweat heater 58 due to cold air leakage. Assuming that the power saver switch 60 is closed but that the thermostatic control 48 is open, contacts 49 and 66 will also be open and the compressor and the evaporator and condenser fans are not energized. Half electrical power will flow from L conductor 20 through the power saver switch 60 and conductor 71 through diode 70 to the anti-sweat heater 58 and back to the N conductor 22 via return conductor 64 and bimetallic switch 56. Thus, with this arrangement, the anti-sweat heater will automatically be subjected to full electrical power when the refrigerating system is operating and the compressor is energized and only half power when the compressor is not energized.

While the preferred embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A refrigerator comprising a cabinet including a storage compartment, an electrical anti-sweat heating means for warming a portion of said cabinet, refrigerating means including a compressor and an evaporator for cooling said compartment, temperature sensing means to energize the compressor at one predetermined temperature and deenergize the compressor at a second lower temperature; and switch means associated with the temperature sensing means to apply full electrical power to the electrical anti-sweat heating means when the compressor is energized and apply half electrical power to the electrical anti-sweat heating means when the compressor is not energized.

2. The refrigerator of claim 1 wherein there is an electrical defrost heater for periodically warming the evaporator to defrost temperatures and a defrost control timer that energizes and deenergizes the defrost heater and the temperature sensing means operates independently of the defrost control timer.

3. The refrigerator of claim 2 wherein the defrost timer runs only when the compressor is energized.

4. The refrigerator of claim 1 wherein there is second switch means not associated with the temperature sensing means that operates to disable the electrical anti-sweat heating means.

5. The refrigerator of claim 4 wherein the second switch means is manually operated.

6. The refrigerator of claim 1 wherein the switch means is located in the circuit between one side of the power line and the electrical anti-sweat heating means.

7. The refrigerator of claim 6 wherein applying half electrical power is achieved by a diode in the circuit parallel to the switch means.

* * * * *